US005482270A

United States Patent [19]

Smith

[11] Patent Number: 5,482,270

[45] Date of Patent: Jan. 9, 1996

[54] HANDGRIP FOR A BAT

[76] Inventor: J. Al Smith, 5918 Portview Cir., Chattanooga, Tenn. 37421

[21] Appl. No.: 315,568

[22] Filed: Sep. 30, 1994

[51] Int. Cl.[6] ..... A63B 51/06

[52] U.S. Cl. ..... 273/72 R; 273/72 A; 273/67 R; 273/81 B; 273/75

[58] Field of Search ..... 273/72 R, 72 A, 273/26 B, 73 J, 75, 81 B; 264/22; 81/422

[56] References Cited

U.S. PATENT DOCUMENTS

| | | | |
|---|---|---|---|
| 1,111,314 | 9/1914 | Murphy . | |
| 2,031,161 | 2/1936 | Hamel | 273/72 |
| 2,091,458 | 8/1937 | Sleight | 273/72 R |
| 2,659,605 | 11/1953 | Tourneau | 273/72 R |
| 2,984,486 | 5/1961 | Jones | 273/32 R |
| 3,104,876 | 9/1963 | Salsinger | 273/72 |
| 3,433,481 | 3/1969 | Tanguay | 273/72 |
| 4,705,657 | 11/1987 | Poulin | 264/22 |
| 5,014,984 | 5/1991 | Brockhoff | 273/72 R |

FOREIGN PATENT DOCUMENTS

| | | | |
|---|---|---|---|
| 9232 | of 1913 | United Kingdom | 273/81 B |
| 137448 | 1/1920 | United Kingdom | 273/81 B |
| 409325 | 4/1934 | United Kingdom | 273/81 B |

*Primary Examiner*—Mark S. Graham

*Attorney, Agent, or Firm*—David L. Baker; Rhodes & Ascolillo

[57] ABSTRACT

A gripping member, for a handle portion of a bat held in at least one hand of a user, has a first longitudinally curvilinear shim and a second longitudinally curvilinear shim positioned substantially opposite the first longitudinally curvilinear shim. The first longitudinally curvilinear shim and the second longitudinally curvilinear shim intimately abut an outer surface of the handle portion. The first longitudinally curvilinear shim and said second longitudinally curvilinear shim each have a resilient cushioning member. The cushioning member of each shim includes four radial indentations into which the fingers of either the right or left hand are placed. The shims are designed to be used as either a left-hand or a right hand grip. The shims may be placed on the handle so that the ball does not split along the grain of a wooden bat and may be located on the handle for a preferred grip. The size of the shims may be selected prior to placement on the handle to accommodate the size of the batter's hand. This ability to only place one shim on a handle greatly enhances the grip, the efficiency and the enjoyment of the game for a one-handed batter. There is a first non-slip surface on an outer surface of the cushioning member to reduce the possibility of longitudinal and radial slippage of the shim and the retaining sleeve. The retaining sleeve member intimately abuts, encloses and tightly secures the shims to the handle portion of the bat.

3 Claims, 6 Drawing Sheets

HANDGRIP FOR A BAT

BACKGROUND OF THE INVENTION

1. Field of the Invention

This invention relates, in general, to a grip enhancement member for a bat or baton and, particularly, to a molded handgrip member for a baseball or softball bat.

2. Description of the Related Art

Throughout the history of base and soft ball, there has existed the problem of maintaining a grip on the bat when the bat strikes the ball or when the batter has to move rapidly out of bodily contact with a wildly thrown ball. Gloves and pine tar have been used with some success and other grips attached to the handle of the bat have been tried.

U.S. Pat. No. 1,111,341 to J. A. Murphy on Sep. 22, 1914 for a Base Ball Bat shows a cord wrapped around the handle of a bat.

U.S. Pat. No. 2,031,161 to O. W. Hamel on Feb.18, 1936 for a Handgrip Member describes a series of peripheral, longitudinally-spaced, circular grooves in the handle portion of a bat. The diameter of the grooves vary along the longitudinal axis of the handle.

U.S. Pat. No. 3,104,876 to F. R. Salsinger on Sep. 24, 1963 for a Baseball Bat Comprising a Square Cross Sectional Striking Area describes a corrugated finger grip attached to the outside of and extending along the length of the handle.

U.S. Pat. No. 3,433,481 to R. J. Tanguay for Baseball Bat Wrappings shows a handle of a baseball bat having a first tape having adhesive on both sides wrapped around the handle, a sleeve of latex filled with walnut shell and cork grit adhered to one adhesive side of the first tape and a second tape with adhesive on one side wrapped around the sleeve and adhered to the sleeve.

The above patents have not addressed the actual gripping mechanics of the two-handed batter or a one-handed batter who has even a greater need for a firm grip on the bat. The present device provides a more positive grip for both one and two-handed batters.

SUMMARY OF THE INVENTION

Injuries are, regrettably, a part of most sporting events and baseball has its share. Considering that a hard projectile (the base or soft ball) is hurled at a person whose sole intent is to strike the projectile (with a bat) and send it back toward a group who hope to stop it somehow and considering that the ball travels at speeds in excess of 70 MPH, it is no wonder players look for ways to reduce the chance of injury.

One potential cause of injury occurs when the batter loses control of the bat and it slips out of his or her hands. Players and nearby spectators can be seriously injured by bats that fly out of a player's hands. In the past, players have used materials such as pine tar on the bat or gloves on their hands to enhance their grip. The "SURE GRIP" hand grip described in the present disclosure reduces the chance of the bat from slipping from the hands of a batter by providing a resilient, cushioned handgrip that can be placed on a handle of a bat.

In one aspect of the present invention, a gripping member, for a handle portion of a bat held in at least one hand of a user, is disclosed. The gripping member has at least one longitudinally curvilinear shim intimately abutting an outer surface of the handle portion. The shim includes a resilient cushioning member, a first non-slip surface on an outer surface of the cushioning member and a retaining sleeve member intimately abutting, enclosing and securing the at least one longitudinally curvilinear shim to the handle portion. The retaining sleeve member has a heat-shrinkable plastic cover and a second non-slip surface for hand and finger contact.

The resilient cushioning member may be made from a polymer material (having a Durometer value of approximately 80) comprising ITW Decon, Dipropylene, Glycol, Dibenzoate, Aromatic Anine, Epoxidized Soybean Oil, Flexane, Methylene Bis and 4-Cyclohexyl Isocyanate Piem and other materials. The resilient cushioning member may have a truncated ellipsoidal cross-sectional shape.

In another aspect of the present invention, a gripping member, for a handle portion of a bat held in at least one hand of a user is described. The gripping member has at least one longitudinally curvilinear shim intimately abutting an outer surface of the handle portion. The shim has a resilient cushioning member. The cushioning member includes four radial indentations into which the fingers of the at least one hand are placed. There is a first non-slip surface on an outer surface the cushioning member and a retaining sleeve member intimately abutting, enclosing and securing the at least one longitudinally curvilinear shim to the handle portion.

It is an object of this invention to provide a Hand Grip for a Bat for one and two-handed batters.

It is another object of this invention to provide a hand grip for a bat that will reduce the chance for an unwanted release of the bat by a batter.

DESCRIPTION OF THE PREFERRED EMBODIMENT

Figure 1:
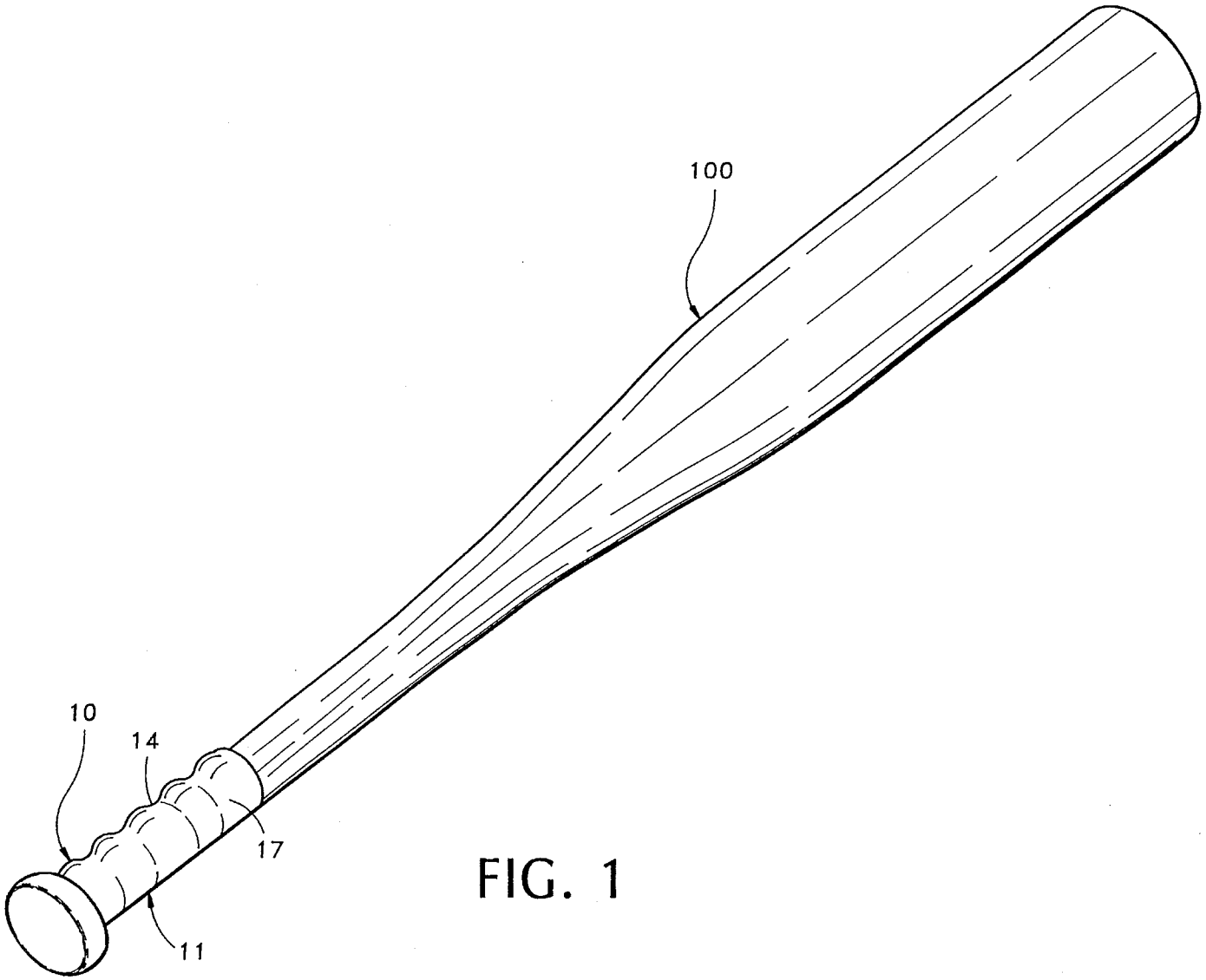
FIG. 1 is a perspective view of the Hand Grip for a Bat showing a grip for a one-handed batter.
Figure 2:
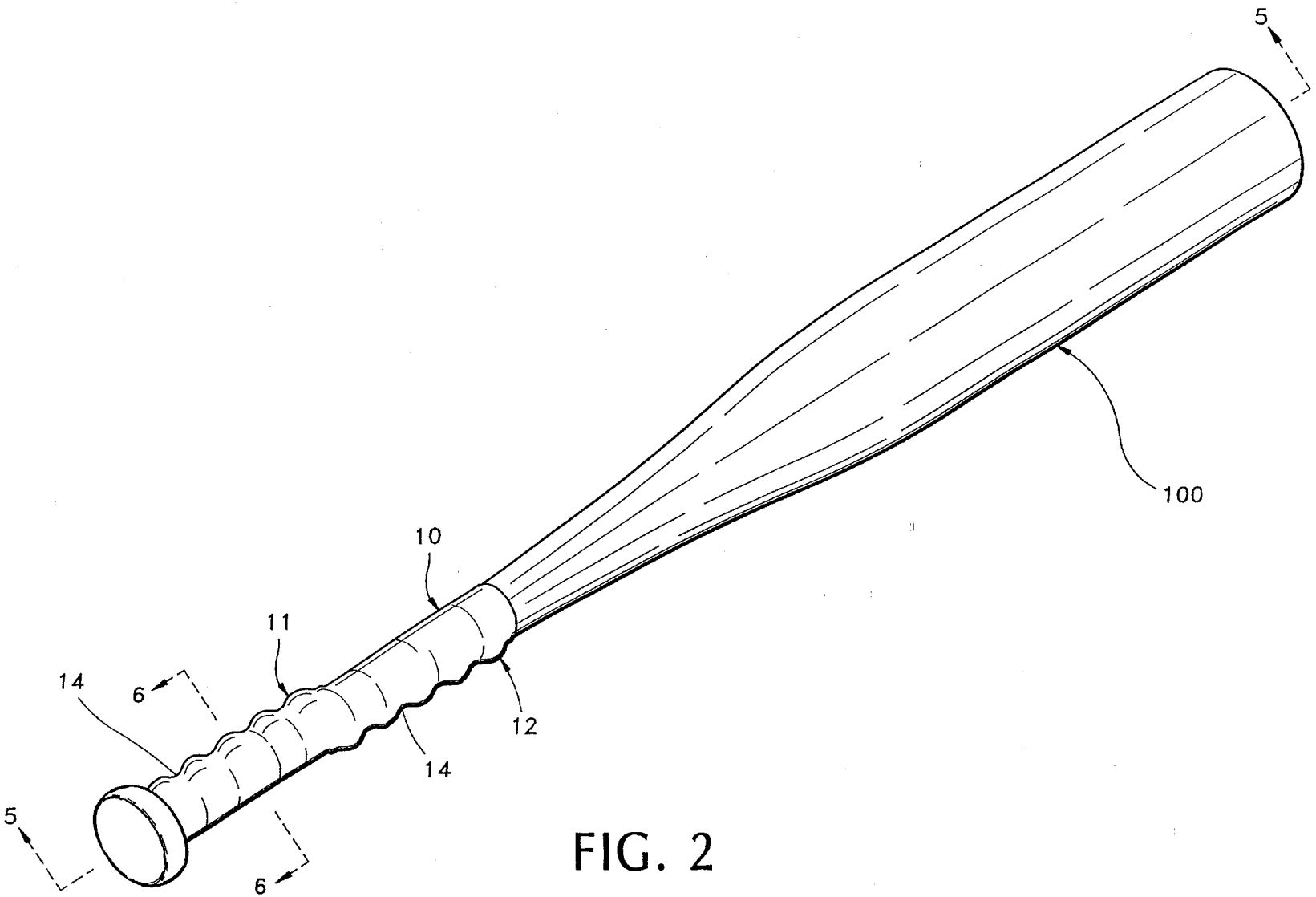
FIG. 2 is a perspective view of the Hand Grip for a Bat showing a grip for a two-handed batter.

Referring to FIGS. 1 through 6, a gripping member 10, for a handle portion 101 of a bat 100 held in at least one hand of a user, is shown and described. The gripping member 10 has a first longitudinally curvilinear shim 11 and a second longitudinally curvilinear shim 12 positioned substantially opposite the first longitudinally curvilinear shim 11. The first longitudinally curvilinear shim 11 and the second longitudinally curvilinear shim 12 intimately abut an outer surface 102 of the handle portion 101.

Figure 3:
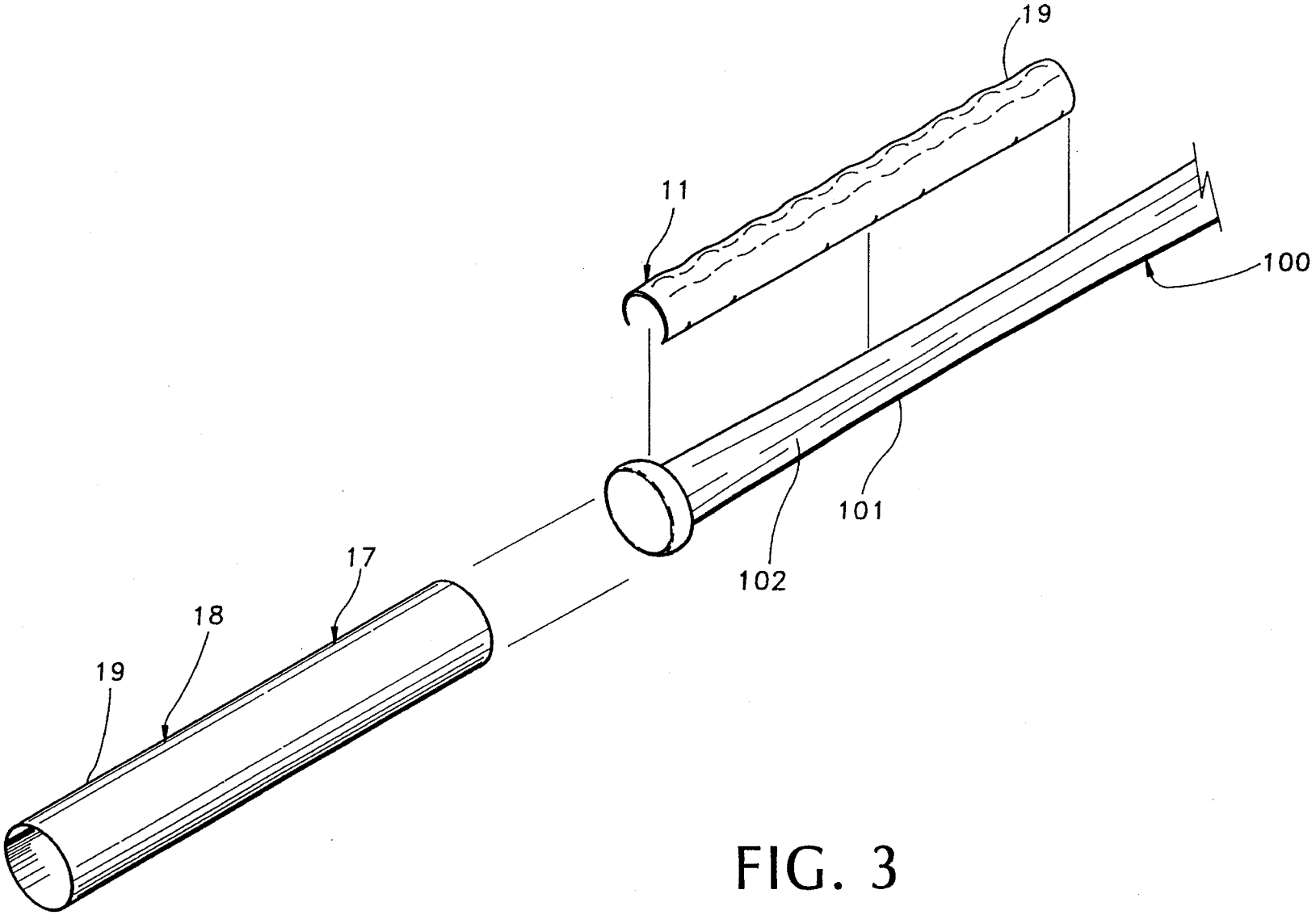
FIG. 3 is a partial perspective view showing the shim and sleeve for a one-handed grip prior to being assembled onto the handle of the bat.
Figure 4:
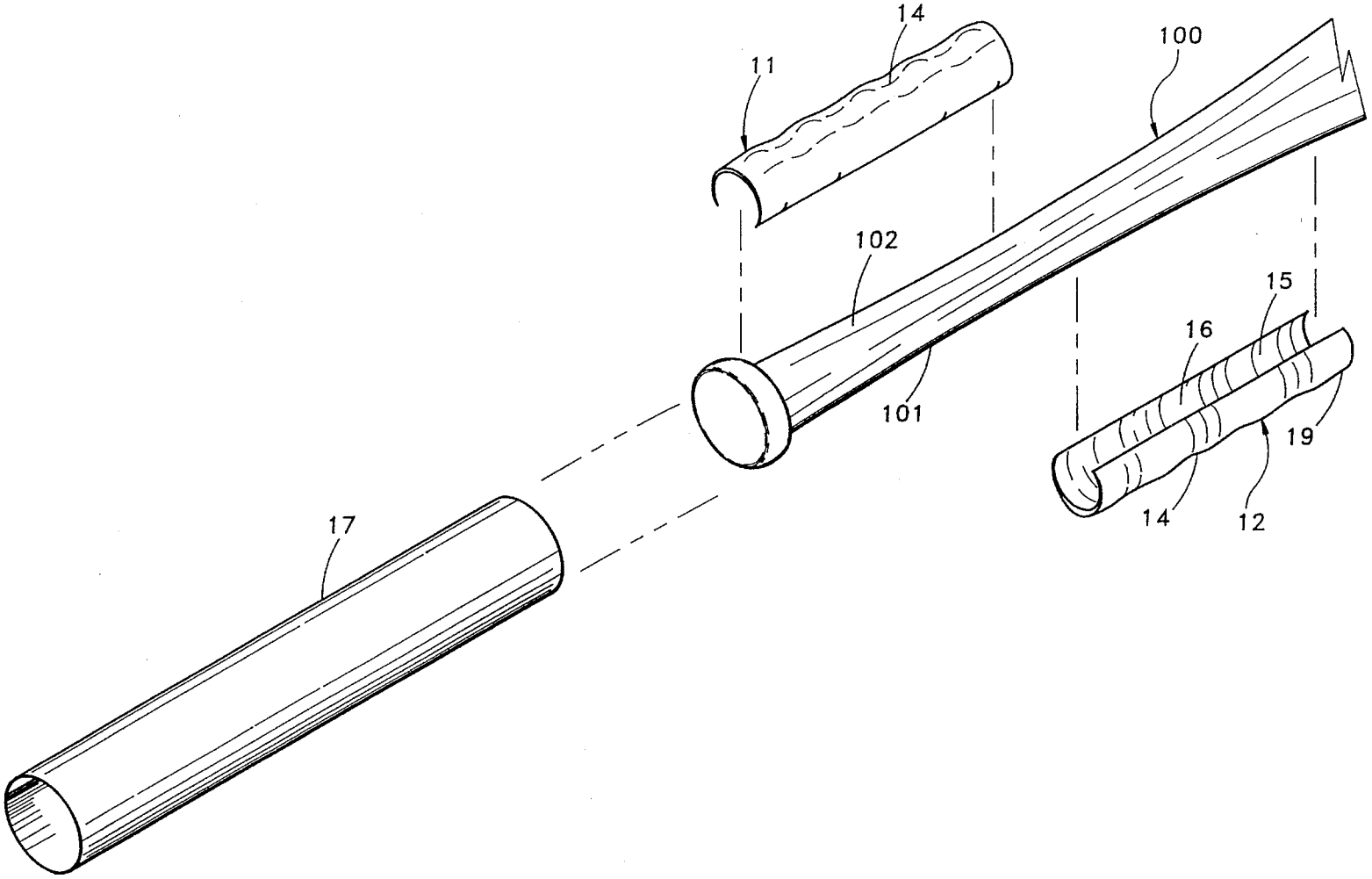
FIG. 4 is a partial perspective view showing the shims and sleeve for a two-handed grip prior to being assembled onto the handle of the bat.
Figure 5:
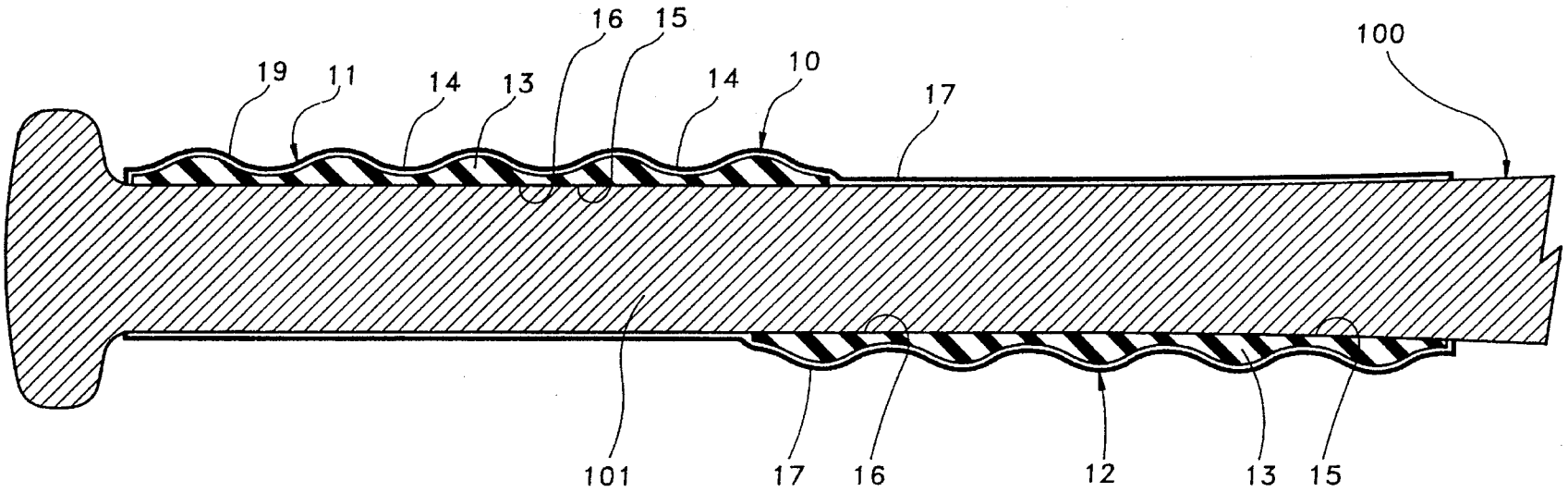
FIG. 5 is a partial enlarged cross-section, along line 5—5 on FIG. 2, of the two-handed grip assembled onto the handle of the bat.
Figure 6:
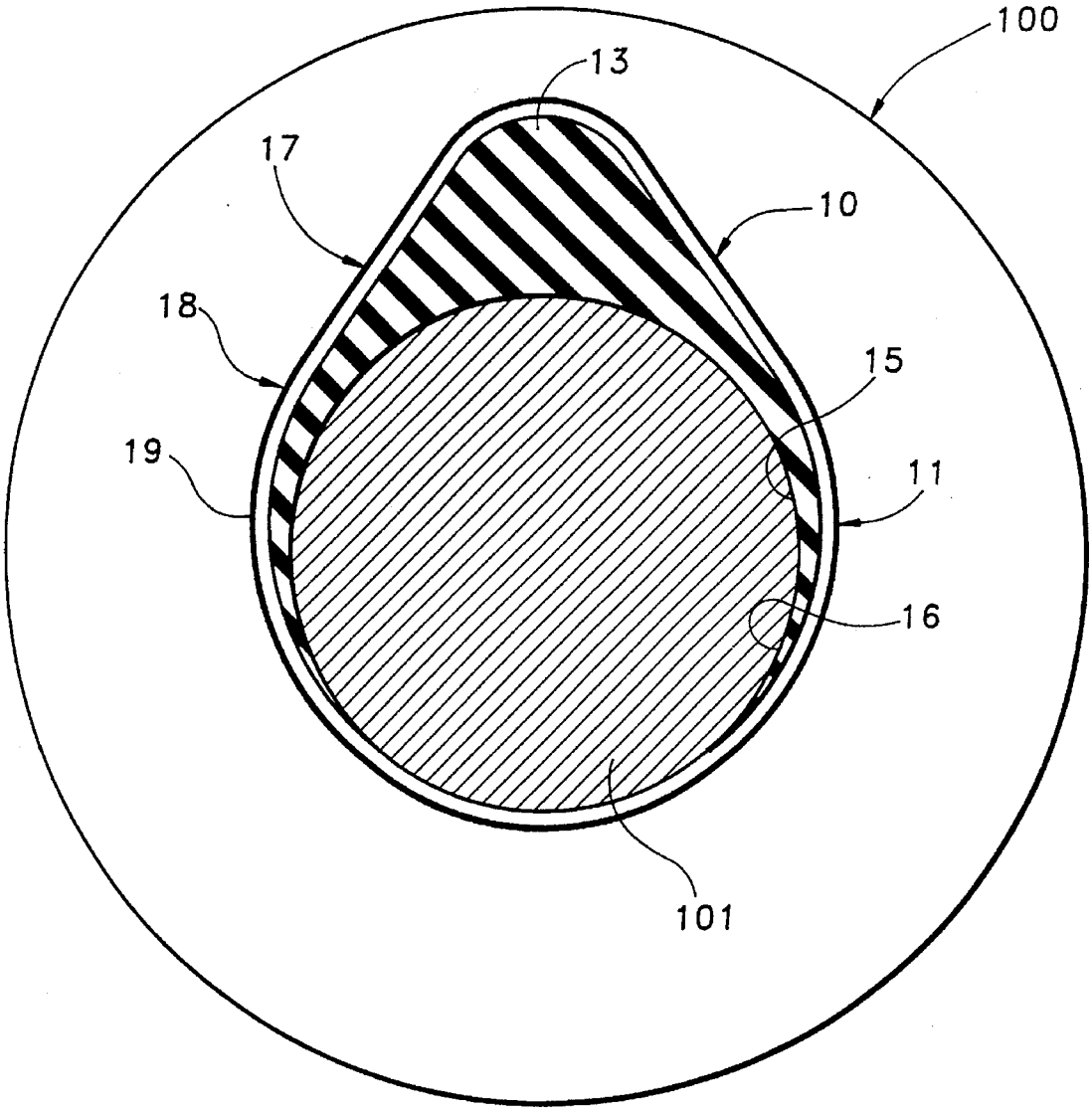
FIG. 6 is a partial enlarged cross-section, along line 6—6 on FIG. 2, of the two-handed grip assembled onto the handle of the bat.

The first longitudinally curvilinear shim 11 and said second longitudinally curvilinear shim 12 each have a resilient cushioning member 13. The cushioning member 13 of each shim 11 and/or 12 includes four radial indentations 14 (there could, if desired, be less than four) into which the fingers of either the right or left hand are placed. The shims 11 and 12 are designed to be used as either a left-hand or a right hand grip. The shims may be placed on the handle 101 so that the ball (not shown) does not split along the grain of a wooden bat 100 and may be custom fitted for the preferred grip of the individual batter. The size of the shims may be selected prior to placement on the handle to accommodate the size of the batter's hand. This ability to only place one shim on a handle (as shown in FIGS. 1 and 3) greatly enhances the grip, the efficiency and the enjoyment of the game for a one-handed batter.

There is a first non-slip surface 15 on an outer surface 16 of the cushioning member 13 to reduce the possibility of longitudinal and radial slippage of the shim and the retaining sleeve member 17. The retaining sleeve member 17 intimately abuts, encloses and tightly secures the at least one longitudinally curvilinear shim 17 to the handle portion 101 of the bat 100. The retaining sleeve 17 includes a heat-shrinkable plastic cover 18 and a second non-slip surface 19 on the cover 18.

In operation, the cushioning member 13 is mixed by methods suitable for manufacturing polymers and molded or formed into the shape shown by accepted plastic molding methods known by one skilled in the art of plastic shaping. Other resilient cushioning materials having a durometer value in the range of 70 to 90 could be used. The material is then formed in the shape shown in the drawings to accommodate the shape of the bat handle 101 and to form indentations 14 that will accommodate the fingers of the hand or hands that will grip the handle 101 of the bat. The preferred embodiment is to manufacture two shims 11 and 12, one for the right hand and one for the left hand. But the two shims could be combined into a one piece shim (not shown) that would accommodate both hands.

The handle portion 101 of the bat should be thoroughly cleaned prior to placing the shim(s) 11 and 12 onto the handle. The person placing the handgrip 10 onto the bat 100 should predetermine the proper place on the handle portion 101 to place the handgrip 10 prior to heat-shrinking the retaining sleeve member 17 over the shim or shims 11 and/or 12. The retaining sleeve member 17 may be shrunk by applying heat using any suitable heat dispensing device such as a hot air blower. The retaining sleeve member 17 should be sufficiently shrunk so as to tightly secure the shims to the handle portion 101 of the bat. The shims have a non-slip surface 15 on the side 16 that contacts the handle portion 101 to reduce the chance of slippage on the handle portion 101. This non-slip surface 15 could be an adhesive or a tacky variation of the polymer material. The retaining sleeve member 17 could be slightly reduced in size until the shims are custom located for the user and once the handgrip is properly positioned for a particular user, the sleeve 17 could be securely emplaced.

This invention, known as a "SURE GRIP" handgrip greatly assists bat manufacturers by supplying them with a handgrip that, if placed incorrectly on the handle during the assembly process, can be removed and easily replaced thus reducing cost of bat manufacture. The present invention 10 is, therefore, very versatile and a great improvement over previous grips.

The foregoing descriptions and drawings of the invention are explanatory and illustrative only, and changes in shape, sizes and arrangements of parts as well certain details of the illustrated construction may be made within the scope of the appended claims without departing from the spirit of the invention.

I claim:

1. A gripping member, for a handle portion of a bat held in at least one hand of a user, said gripping member comprising:

(a) a first longitudinally curvilinear shim and a second longitudinally curvilinear shim positioned substantially opposite the first longitudinally curvilinear shim;

b) the first longitudinally curvilinear shim and the second longitudinally curvilinear shim intimately abutting an outer surface of the handle portion, said first longitudinally curvilinear shim and said second longitudinally curvilinear shim, each comprising:

a resilient cushioning member comprising:

at least four radial indentations into which the fingers of the at least one hand are placed; and a first non-slip surface on an outer surface of the cushioning member; and (c) a retaining sleeve member, intimately abutting, enclosing and securing the first longitudinally curvilinear shim and said second longitudinally curvilinear shim to the handle portion, the retaining sleeve member comprising:

a heat-shrinkable plastic cover; and a second non-slip surface on the cover.

2. A gripping member as described in claim 1 wherein the resilient cushioning member further comprises a polymer material comprising ITW Decon, Dipropylene, Glycol, Dibenzoate, Aromatic Anine, Epoxidized Soybean Oil, Flexane, Methylene Bis and 4-Cyclohexyl Isocyanate Piem.

3. A gripping member as described in claim 1 wherein the resilient cushioning member further comprises a truncated ellipsoidal cross-sectional shape.

* * * * *